US011493869B2

(12) United States Patent
Sato

(10) Patent No.: US 11,493,869 B2
(45) Date of Patent: Nov. 8, 2022

(54) IMAGE FORMING APPARATUS

(71) Applicant: CANON KABUSHIKI KAISHA, Tokyo (JP)

(72) Inventor: Hiroki Sato, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/231,477

(22) Filed: Apr. 15, 2021

(65) Prior Publication Data

US 2021/0341864 A1 Nov. 4, 2021

(30) Foreign Application Priority Data

Apr. 30, 2020 (JP) ..... JP2020-080389

(51) Int. Cl.
*G03G 15/00* (2006.01)

(52) U.S. Cl.
CPC ..... *G03G 15/5058* (2013.01); *G03G 15/5025* (2013.01)

(58) Field of Classification Search
CPC ..... G03G 15/5054; G03G 15/5058
See application file for complete search history.

(56) References Cited

U.S. PATENT DOCUMENTS 9,820,393 B2 * 11/2017 Saitou ..... E02F 3/325
2011/0026981 A1 * 2/2011 Sakai ..... G03G 15/0194 399/301

FOREIGN PATENT DOCUMENTS

JP 2006-208266 A 8/2006
JP 2006208266 A * 8/2006

* cited by examiner

*Primary Examiner* — Leon W Rhodes, Jr.
(74) *Attorney, Agent, or Firm* — Venable LLP

(57) ABSTRACT

An image forming apparatus includes an image bearing member, an optical sensor configured to detect a pattern image formed on the image bearing member, and an attachment member to which the optical sensor is attached. The optical sensor includes a circuit board, a light emitting element and a light receiving element which are provided on a first side of the circuit board, and a connector provided on a second side opposite to the first side of the circuit board. The attachment member has a surface contacting the second side of the circuit board. In an insertion/removal direction of a cable to be connected to the connector, a first thickness, from the surface, of a part of a portion, contacting the second side, of the attachment member is smaller than a second thickness, from the surface, of a portion, not contacting the second side, of the attachment member.

17 Claims, 9 Drawing Sheets

IMAGE FORMING APPARATUS

BACKGROUND OF THE INVENTION

Field of the Invention

The present invention relates to an image forming apparatus including an attachment member to which an optical sensor configured to detect a pattern image is attached.

Description of the Related Art

Hitherto, a color image forming apparatus such as a copying machine, a printer, or a facsimile machine, which employs tandem electrophotography, corrects position misregistration and density deviation for each color. For the correction, a color misregistration detection pattern and a density detection pattern are formed by an image forming portion for each color, and a color misregistration amount and a density deviation amount are detected to correct color misregistration and the density deviation. The color misregistration detection pattern and the density detection pattern are detected by a light detector (optical sensor) arranged in the vicinity of an intermediate transfer belt. The light detector includes a light emitting element and a light receiving element. The light emitting element is configured to illuminate the intermediate transfer belt, and the color misregistration detection pattern and the density detection pattern, which are formed on the intermediate transfer belt. The light receiving element is configured to receive reflected light from the intermediate transfer belt, and the color misregistration detection pattern and the density detection pattern. The color misregistration amount and the density deviation amount are detected based on a difference between a reflected light amount from the intermediate transfer belt and a reflected light amount from the color misregistration detection pattern and a difference between the reflected light amount from the intermediate transfer belt and a reflected light amount from the density detection pattern, respectively.

Along with downsizing of the image forming apparatus, downsizing of an optical portion of the light detector is demanded. In Japanese Patent Application Laid-Open No. 2006-208266, there is disclosed a light detector that is downsized by directly mounting the light emitting element and the light receiving element on a circuit board so that a distance between the light emitting element and the light receiving element is reduced as compared to that in a related-art configuration in which components (lead components) to be mounted through a lead frame are used. A control circuit component, a connector for connection to an external controller, and other components are mounted on a surface of the circuit board, which is opposite to the surface on which the light emitting element and the light receiving element are directly mounted, to thereby downsize the circuit board so that the optical detector can be further downsized.

The light detector is fixed to the image forming apparatus in such a manner as to be opposed to the intermediate transfer belt. In view of ease of assembly for fixing the light detector to the image forming apparatus, the light detector is fixed to a fixing unit in advance, and the fixing unit to which the light detector has been fixed is fixed to the image forming apparatus. Further, the light detector is fixed to the image forming apparatus in such a manner as to focus on a surface of the intermediate transfer belt to detect a color misregistration detection pattern and a density detection pattern, which are formed on the intermediate transfer belt.

Thus, when the fixing unit is fixed to the image forming apparatus, a change in distance between the light detector and the intermediate transfer belt from a predetermined distance, which may be caused by deformation such as warp of the fixing unit, is required to be prevented. Thus, a thickness of the fixing unit is increased to increase stiffness of the fixing unit.

However, the circuit board with the connector provided on a surface that is opposite to the surface on which the light emitting element and the light receiving element are provided is fixed to the fixing unit by inserting the connector into a through-hole formed in the fixing unit. When the thickness of the fixing unit is increased so as to increase the stiffness of the fixing unit, a depth of the through-hole is increased. When a cable is to be inserted into the through-hole so as to be connected to the connector provided in a bottom of the through-hole having a large depth, the connector is difficult to see. Further, when the cable is to be connected to the connector, a hand that holds the cable may interfere with the fixing unit, resulting in a decrease in connection workability.

SUMMARY OF THE INVENTION

According to an embodiment of the present invention, there is provided an image forming apparatus, comprising: an image bearing member; an image forming unit configured to form an image on the image bearing member; a transfer unit configured to transfer the image from the image bearing member to a sheet; an optical sensor configured to detect a pattern image formed on the image bearing member; and an attachment member to which the optical sensor is attached, wherein the optical sensor includes a circuit board, a light emitting element and a light receiving element, which are provided on a first side of the circuit board, and a connector provided on a second side of the circuit board, which is opposite to the first side, wherein the attachment member has a surface contacting the second side of the circuit board, and wherein in an insertion/removal direction of a cable to be connected to the connector, a first thickness, from the surface, of a part of a portion, contacting the second side, of the attachment member is smaller than a second thickness, from the surface, of a portion, not contacting the second side, of the attachment member.

Further features of the present invention will become apparent from the following description of exemplary embodiments with reference to the attached drawings.

DESCRIPTION OF THE EMBODIMENTS

Embodiments of the present invention are described below with reference to the accompanying drawings.

First Embodiment (Image Forming Apparatus)

Figure 1:
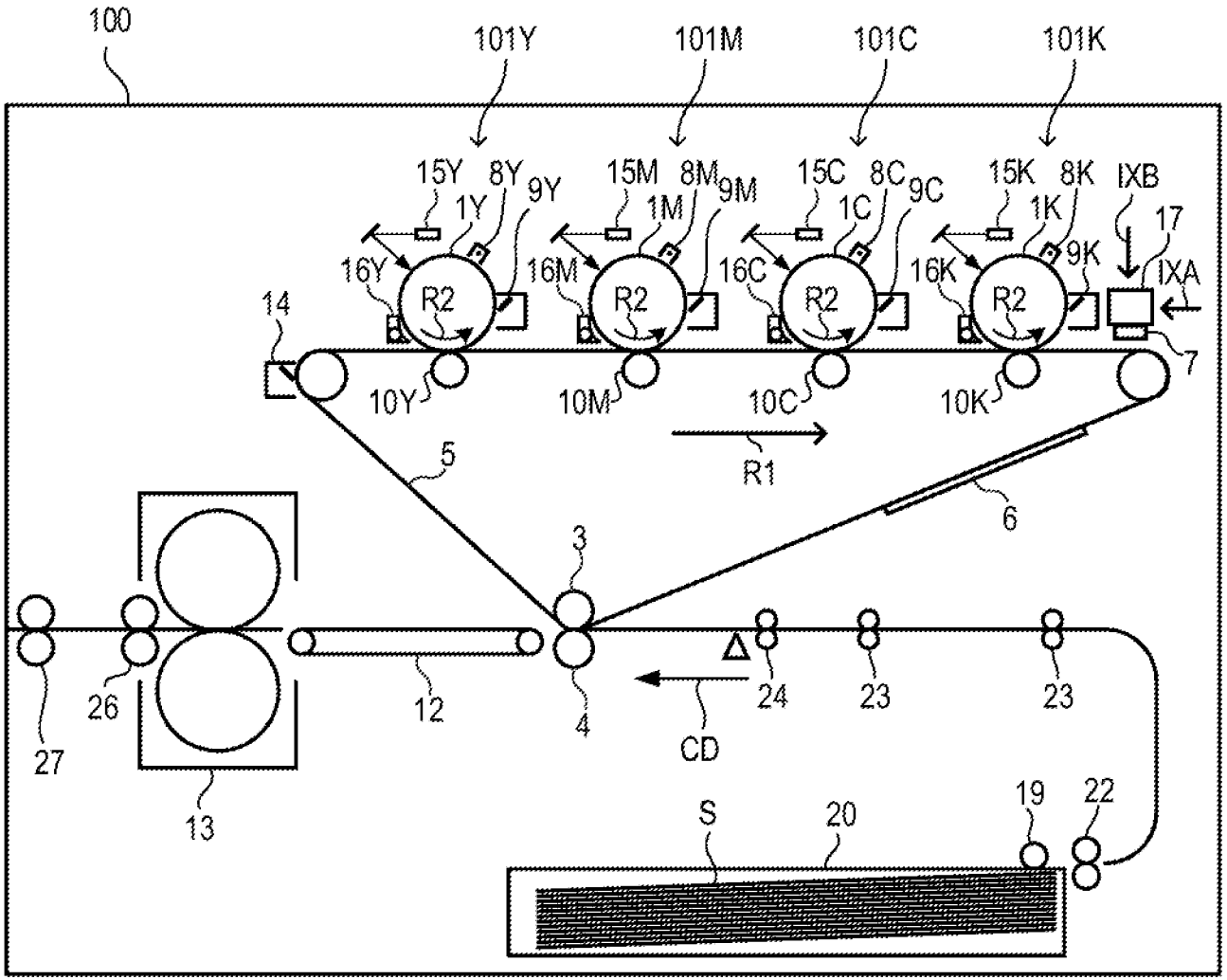
FIG. 1 is a sectional view of an image forming apparatus.

FIG. 1 is a sectional view of an image forming apparatus 100. The image forming apparatus 100 is a printer configured to form a color image on a recording medium S such as a paper sheet (sheet) with toners of a plurality of colors by using electrophotography. The image forming apparatus 100 includes four image forming portions 101 (101Y, 101M, 101C, and 101K). The image forming portion 101Y is configured to form a yellow image with a yellow toner. The image forming portion 101M is configured to form a magenta image with a magenta toner. The image forming portion 101C is configured to form a cyan image with a cyan toner. The image forming portion 101K is configured to form a black image with a black toner. The alphabet letters Y, M, C, and K in the reference symbols represent yellow, magenta, cyan, and black, respectively. In the following description, the alphabet letters Y, M, C, and K in the reference symbols may be omitted unless otherwise needed. The four image forming portions 101 have the same structure except for colors of developers (toners).

The image forming portion 101 includes a photosensitive drum 1 corresponding to a photosensitive member. A charging device 8, a light scanning device (laser writing portion) 15, a developing device 16, a primary transfer roller 10, and a drum cleaner 9 are arranged around the photosensitive drum 1. An intermediate transfer belt (image bearing member) 5 having an endless shape is arranged below the photosensitive drums 1. The intermediate transfer belt 5 is rotated to be moved in a moving direction R1. The primary transfer rollers 10 are arranged in such a manner as to be opposed to the photosensitive drums 1 across the intermediate transfer belt 5. Each of the primary transfer rollers 10 is configured to transfer a toner image formed on the photosensitive drum 1 onto the intermediate transfer belt 5. A secondary transfer roller 4 is arranged in such a manner as to be opposed to a belt support roller 3 across the intermediate transfer belt 5. The secondary transfer rollers 4 is configured to transfer a toner image formed on the intermediate transfer belt 5 onto the recording medium S.

A feed cassette 20 configured to receive the recording media S such as paper sheets (sheets) is arranged in a lower part of the image forming apparatus 100. The recording medium S is fed from the feed cassette 20 by a pickup roller 19, and is then conveyed to the secondary transfer roller 4 by feed rollers 22, conveyance rollers 23, and registration rollers 24. A conveyance belt 12 and a fixing device 13 are arranged downstream of the secondary transfer roller 4 in a conveyance direction CD of the recording medium S. The fixing device 13 is configured to fix a toner image onto the recording medium S.

An image forming process performed by the image forming apparatus 100 is now described. Image forming processes performed in the four image forming portions 101 are the same, and thus the image forming process performed in the image forming portion 101Y configured to form a yellow toner image is representatively described. Thus, a description of the image forming processes in the image forming portion 101M configured to form a magenta toner image, the image forming portion 101C configured to form a cyan toner image, and the image forming portion 101K configured to form a black toner image is herein omitted.

A photosensitive drum 1Y is rotated in a direction indicated by an arrow R2 in FIG. 1. A charging device 8Y uniformly charges a surface of the photosensitive drum 1Y to a predetermined potential. A light scanning device 15Y causes a semiconductor laser (not shown) serving as a light source to emit laser light (light beam) modulated in accordance with image information of yellow to thereby form an electrostatic latent image on the uniformly charged surface of the photosensitive drum 1Y. A developing device 16Y develops the electrostatic latent image with a yellow toner (developer) to form a yellow toner image. A primary transfer roller 10Y transfers the yellow toner image formed on the photosensitive drum 1Y onto the intermediate transfer belt 5. The toner remaining on the photosensitive drum 1Y after the primary transfer is collected by a drum cleaning device 9Y.

Similarly, a magenta toner image formed by the image forming portion 101M is transferred in such a manner as to be superimposed on the yellow toner image formed on the intermediate transfer belt 5 with high accuracy. Then, a cyan toner image and a black toner image are transferred in such a manner as to be superimposed in order on the magenta toner image formed on the intermediate transfer belt 5. As a result, the toner images of the four colors are superimposed in order on the intermediate transfer belt 5 to form a color toner image 6.

The recording medium S, which has been conveyed from the feed cassette 20, is conveyed to the secondary transfer roller 4 in such a manner that a leading end of the color toner image 6 on the intermediate transfer belt 5 and a leading end of the recording medium S are registered with each other by the registration rollers 24. The color toner image 6 on the intermediate transfer belt 5 is transferred onto the recording medium S by the second transfer roller 4. The toners remaining on the intermediate transfer belt 5 after the secondary transfer are collected by an intermediate transfer belt cleaner 14. The recording medium S onto which the toner image has been transferred is conveyed to the fixing device 13 by the conveyance belt 12. The fixing device 13 heats and presses the recording medium S to fix the toner image onto the recording medium S. The recording medium S carrying the image formed thereon is delivered to an outside of the image forming apparatus 100 by fixing outlet rollers 26 and delivery rollers 27.

Color misregistration may sometimes occur in the color toner image 6 formed on the intermediate transfer belt 5 due to a variation in manufacture of the light scanning devices 15 and the photosensitive drums 1, deformation of components, which is caused by a temperature rise, and a variation in conveyance of the intermediate transfer belt 5. The color misregistration occurs due to a shift of positions at which the yellow toner image, the magenta toner image, the cyan toner image, and the black toner image are formed. The color misregistration is corrected based on a result of detection, which is obtained by detecting a color misregistration detection pattern formed on the intermediate transfer belt 5 with use of a pattern sensor (optical sensor) 7.

Further, an image density is varied depending on temperature and humidity conditions of an environment where the image forming apparatus 100 is used and a frequency of use of each of the colors. The variation in image density may cause a density deviation, which is a deviation of the image density from a predetermined density. The density deviation is corrected by controlling the light scanning devices 15, the developing devices 16, and the photosensitive drums 1 based on a result of detection, which is obtained by detecting a density detection pattern formed on the intermediate transfer belt 5 with use of the pattern sensor 7.

(Pattern Sensor)

Figure 9A:
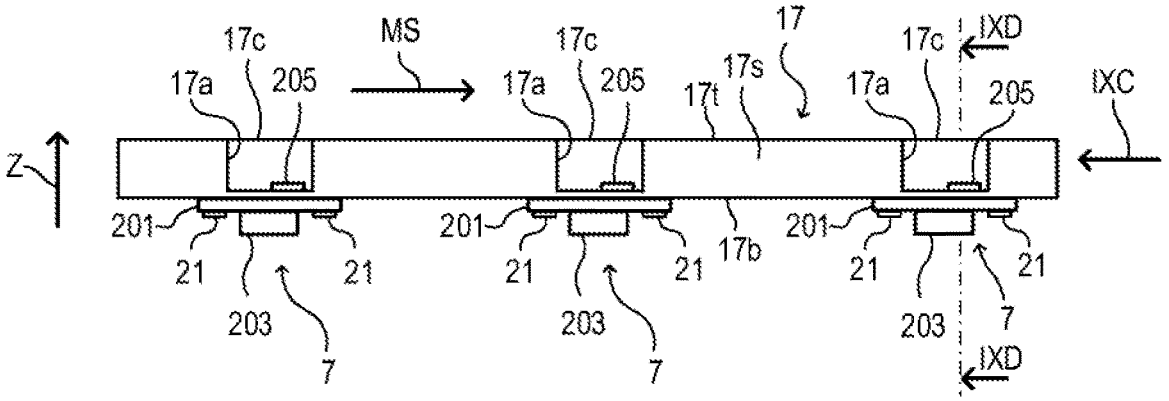
FIG. 9A, FIG. 9B, FIG. 9C, and FIG. 9D are views for illustrating an attachment member to which the pattern sensors are attached.

The pattern sensor 7 corresponding to a light detector is arranged in the vicinity of the intermediate transfer belt 5. The pattern sensor 7 is fixed to an attachment member 17 with screws 21 (FIG. 9A). The pattern sensor 7 is fixed to the image forming apparatus 100 through intermediation of the attachment member 17 in such a manner that a distance between the pattern sensor 7 and the intermediate transfer belt 5 is set equal to a predetermined distance to focus on a surface of the intermediate transfer belt 5. The pattern sensor 7 is configured to detect density detection patterns and color misregistration detection patterns of the colors, which are formed on the intermediate transfer belt 5, at predetermined timing. The density and the color misregistration are corrected based on a result of detection performed by the pattern sensor 7.

Figure 2:
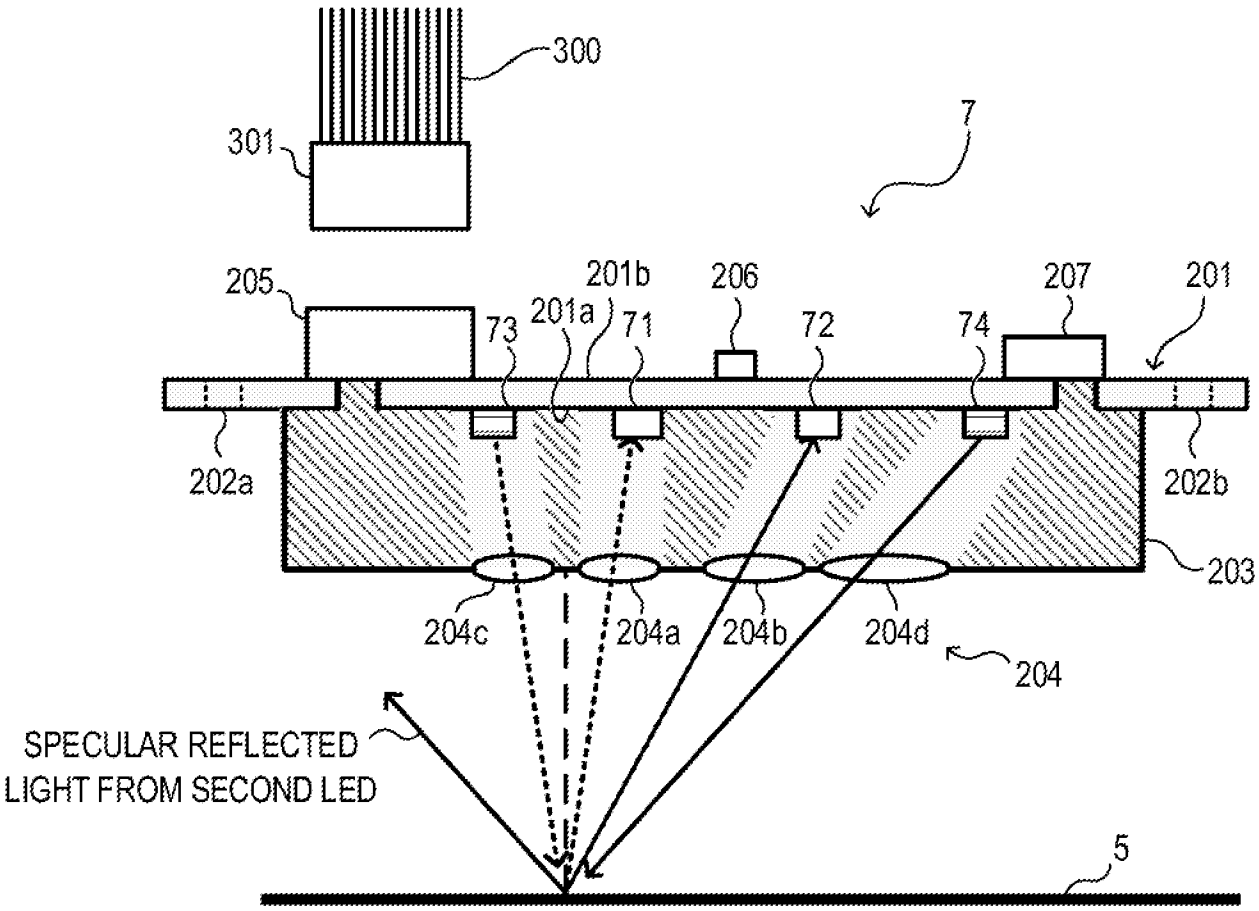
FIG. 2 is an explanatory view of a pattern sensor.

FIG. 2 is an explanatory view of the pattern sensor 7. The pattern sensor 7 includes a circuit board (hereinafter referred to simply as "board") 201. A first photodiode (hereinafter referred to as "first PD") 71 and a second photodiode (hereinafter referred to as "second PD") 72, which correspond to light receiving elements, are mounted on a front surface (first side) 201*a* of the board 201. A first light emitting diode (hereinafter referred to as "first LED") 73 and a second light emitting diode (hereinafter referred to as "second LED") 74, which correspond to light emitting elements, are mounted on the front surface 201*a* of the board 201. The first PD 71, the second PD 72, the first LED 73, and the second LED 74 are surface-mount elements, and are arranged on one board 201.

A housing 203 configured to cover the first PD 71, the second PD 72, the first LED 73, and the second LED 74 is mounted to the front surface 201*a* of the board 201. A lens group 204 including a plurality of lenses 204*a*, 204*b*, 204*c*, and 204*d* is provided to the housing 203. The lenses 204*a*, 204*b*, 204*c*, and 204*d* are arranged in the vicinity of the first PD 71, the second PD 72, the first LED 73, and the second LED 74, respectively. Light guide paths are formed between the lenses 204*a*, 204*b*, 204*c*, and 204*d* and the first PD 71, the second PD 72, the first LED 73, and the second LED 74, respectively, in the housing 203.

Light emitted from the first LED 73 corresponding to a light emitting portion for specular reflected light passes through the light guide path in the housing 203 and the lens 204*c* to travel in a direction of an optical axis (dotted line in FIG. 2) to irradiate the intermediate transfer belt 5. Specular reflected light, which has been specularly reflected by the intermediate transfer belt 5, passes through the lens 204*a* and the light guide path in the housing 203 to be incident on the first PD 71 corresponding to a light receiving portion for specular reflected light (specular reflection color misregistration detection light receiving portion, specular reflection density detection light receiving portion). As illustrated in FIG. 2, the first LED 73 and the first PD 71 are arranged at such positions that an incident angle and a reflection angle of the light from the first LED 73 with respect to the intermediate transfer belt 5 are equal to each other. The first PD 71 functions as a light receiving unit configured to receive the specular reflected light of the light that has been emitted from the first LED 73 to the intermediate transfer belt 5 and reflected by the intermediate transfer belt 5.

Meanwhile, light emitted from the second LED 74 corresponding to a light emitting portion for scattered reflected light passes through the light guide path in the housing 203 and the lens 204*d* and travels in a direction of an optical axis (solid line in FIG. 2) to irradiate the intermediate transfer belt 5. Scattered reflected light, which has been scattered and reflected by the intermediate transfer belt 5, passes through the lens 204*b* and the light guide path in the housing 203 to be incident on the second PD 72 corresponding to a light receiving portion for scattered reflected light (scattered reflected density detection light receiving portion). As illustrated in FIG. 2, the second LED 74 and the second PD 72 are arranged at such positions that an incident angle of light emitted from the first LED 74 and a reflection angle of the scattered reflected light with respect to the intermediate transfer belt 5 are not equal to each other. The second PD 72 functions as a light receiving unit configured to receive the scattered reflected light of the light that has been emitted from the second LED 74 to the intermediate transfer belt 5 and reflected by the intermediate transfer belt 5.

A connector 205, a control integrated circuit (hereinafter referred to as "control IC") 207, and other mounted components 206 are provided on a back surface (second side) 201*b* of the board 201, which is opposite to the front surface 201*a*. The control IC 207 includes a core chip, which is an integrated circuit, and the core chip is connected onto the board 201 by a chip-on-board method through wire bonding. A sealing resin is applied onto the control IC 207 so as to protect the core chip and the wire bonding. The control IC 207 controls operation of each of the first PD 71, the second PD 72, the first LED 73, and the second LED 74, which are optical elements.

The connector 205 for the pattern sensor 7 is connected to a connector 301 for a cable 300. The pattern sensor 7 is electrically connected to a CPU 109 (FIG. 3), which is configured to control the whole image forming apparatus 100, via the cable 300 connected to the connector 205. The control IC 207 communicates with the CPU 109 to control light emission amounts of the first LED 73 and the second LED 74. The other mounted components 206 include, for example, a capacitor configured to stabilize power to be supplied to the control IC 207. The board 201 has a first positioning hole 202*a* and a second positioning hole 202*b*, which are openings for allowing passage of the screws 21 (FIG. 9A) configured to fix the pattern sensor 7 to the attachment member 17.

(Electrical Configuration of Image Forming Apparatus)

Figure 3:
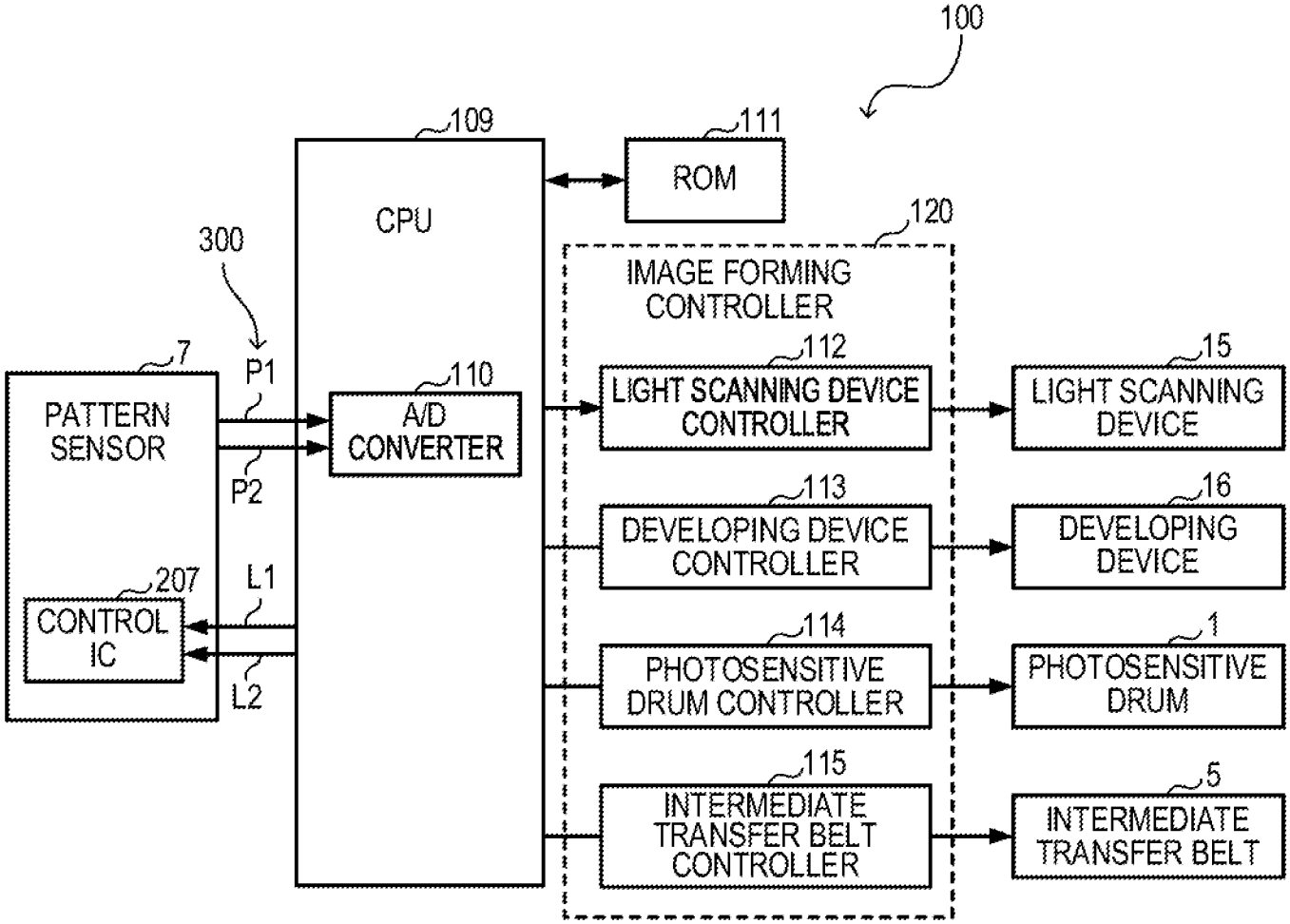
FIG. 3 is a block diagram for illustrating an electrical configuration of the image forming apparatus.

FIG. 3 is a block diagram for illustrating an electrical configuration of the image forming apparatus 100. The image forming apparatus 100 includes the CPU 109, a ROM 111, and an image forming controller 120, which correspond to control units. The cable 300 is configured to electrically connect the pattern sensor 7 and the CPU 109 to each other. The cable 300 includes signal lines. The CPU 109 outputs a first light emission signal L1 and a second light emission signal L2 to the control IC 207 to control lighting of the first LED 73 and the second LED 74 of the pattern sensor 7. The pattern sensor 7 is configured to convert light reception amounts of the first PD 71 and the second PD 72, which are configured to receive reflected light from the intermediate transfer belt 5 or a toner pattern formed on the intermediate transfer belt 5, into voltages, and output the voltages as a first detection signal P1 and a second detection signal P2. After conversion from the analog signals into digital signals through an analog-digital converter (hereinafter referred to as "A/D converter") 110 that is built in the CPU 109, the first detection signal P1 and the second detection signal P2 are input to the CPU 109.

The image forming controller 120 includes a light scanning device controller 112, a developing device controller 113, a photosensitive drum controller 114, and an intermediate transfer belt controller 115. The light scanning device controller 112 is configured to control the light scanning devices 15. The developing device controller 113 is configured to control the developing devices 16. The photosensitive drum controller 114 is configured to control the photosensitive drums 1. The intermediate transfer belt controller 115 is configured to control the intermediate transfer belt 5. The CPU 109 is electrically connected to the light canning device controller 112, the developing device controller 113, the photosensitive drum controller 114, the intermediate transfer belt controller 115, and the ROM 111.

The CPU 109 is configured to control the whole image forming apparatus 100 in accordance with various instructions. The CPU 109 executes an image forming operation in accordance with a program stored in the ROM 111. The CPU 109 causes the image forming controller 120 to control the light scanning devices 15, the developing devices 16, the photosensitive drums 1, and the intermediate transfer belt 5 to form the toner image on the intermediate transfer belt 5. Further, the CPU 109 forms a toner density detection toner pattern (hereinafter referred to as "density detection pattern image") on the intermediate transfer belt 5 in accordance with toner density detection image data stored in the ROM 111. Further, the CPU 109 forms a color misregistration detection toner pattern (hereinafter referred to as "color misregistration detection pattern image") on the intermediate transfer belt 5 in accordance with color misregistration detection image data stored in the ROM 111.

When a color misregistration amount is to be detected, the CPU 109 turns on the first LED 73 of the pattern sensor 7. The first LED 73 illuminates the intermediate transfer belt 5 and the color misregistration detection pattern image formed on the intermediate transfer belt 5. The first PD 71 receives the reflected light from the intermediate transfer belt 5 and the color misregistration detection pattern image formed on the intermediate transfer belt 5, and outputs the first detection signal P1 to the A/D converter 110. The A/D converter 110 converts the first detection signal P1, which is the analog signal, into the digital signal (digital value). The CPU 109 detects the color misregistration amount from the digital signal of the first detection signal P1. The CPU 109 calculates a correction amount for the color misregistration amount based on the color misregistration amount (result of detection). The CPU 109 corrects the color misregistration amount based on the calculated correction amount.

When the toner density is to be detected, the CPU 109 turns on the first LED 73 and the second LED 74 of the pattern sensor 7. The first LED 73 and the second LED 74 illuminate the intermediate transfer belt 5 and the density detection pattern image formed on the intermediate transfer belt 5. The first PD 71 and the second PD 72 receive the reflected light from the intermediate transfer belt 5 and the density detection pattern image formed on the intermediate transfer belt 5, and output the first detection signal P1 and the second detection signal P2 to the A/D converter 110. The A/D converter 110 converts the first detection signal P1 and the second detection signal P2, which are the analog signals, into digital signals (digital values). The CPU 109 detects a level of a toner density from the digital signals of the first detection signal P1 and the second detection signal P2. The CPU 109 calculates a correction amount for the toner density based on the level of the toner density (result of detection). The CPU 109 corrects the toner density based on the calculated correction amount.

(Color Misregistration Detection Pattern Image)

Figure 4:
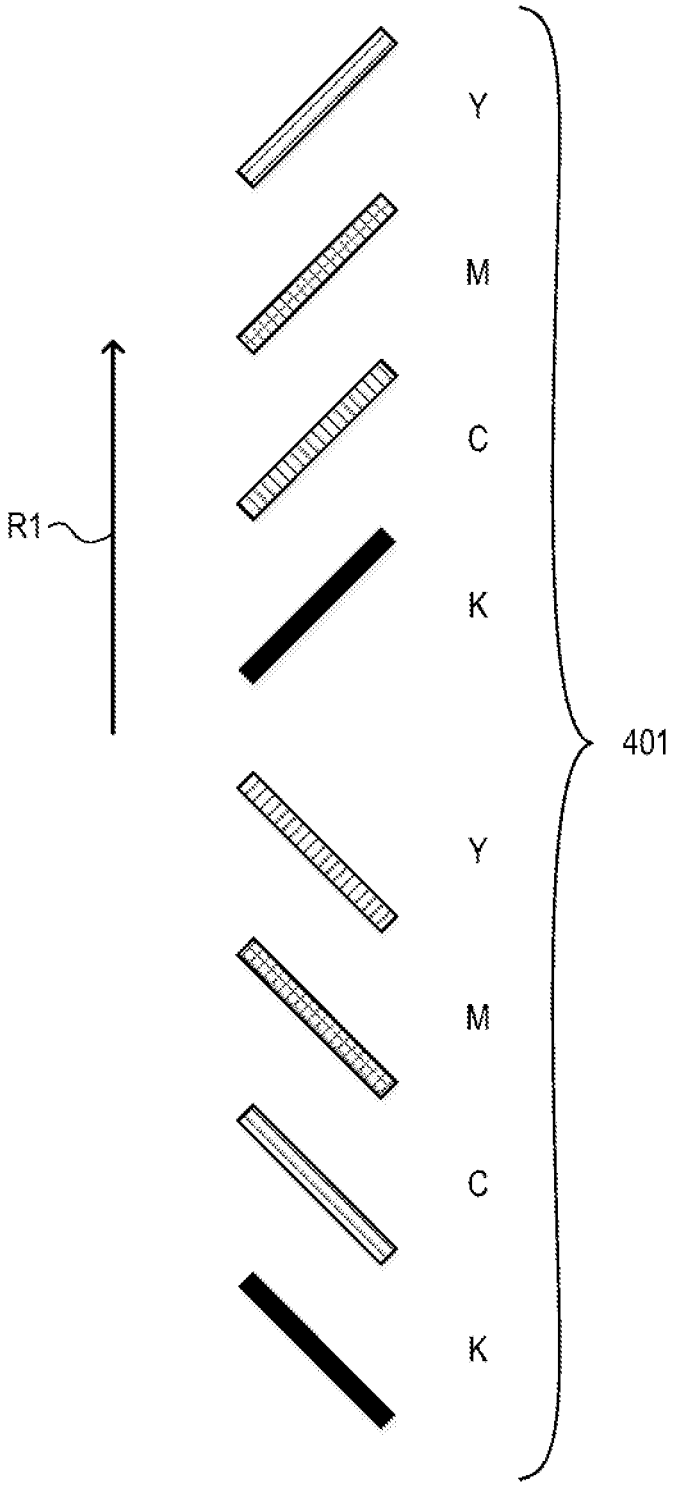
FIG. 4 is a view for illustrating a color misregistration detection pattern image.

Next, the color misregistration detection pattern image to be formed on the intermediate transfer belt 5 when the CPU 109 executes color misregistration detection is described. FIG. 4 is a view for illustrating a color misregistration detection pattern image 401. The color misregistration detection pattern image 401 includes two sets of toner patterns of yellow (Y), magenta (M), cyan (C), and black (K). One set of the toner patterns of yellow (Y), magenta (M), cyan (C), and black (K) is inclined at 45 degrees with respect to the moving direction R1 of the intermediate transfer belt 5. Another set of the toner patterns of yellow (Y), magenta (M), cyan (C), and black (K) is inclined at −45 degrees with respect to the moving direction R1 of the intermediate transfer belt 5.

Figure 5:
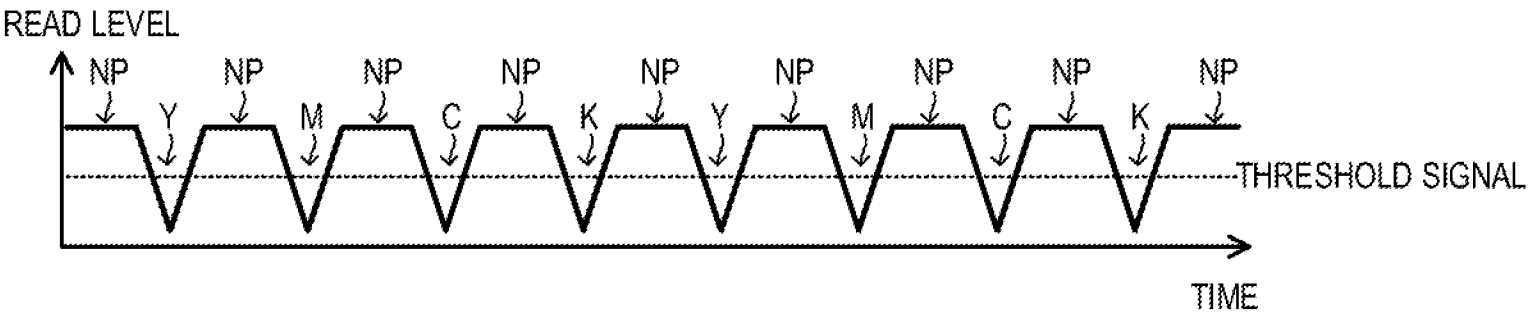
FIG. 5 is a graph for showing an output waveform from a pattern sensor that has detected the color misregistration detection pattern image.

FIG. 5 is a graph for showing an output waveform from the pattern sensor 7 that has detected the color misregistration detection pattern image 401. A reflectance at the surface of the intermediate transfer belt 5 is high in non-patterned portions NP in which an underlayer portion of the intermediate transfer belt 5 is visible. Thus, a read level of the first detection signal P output from the first PD 71 that receives the specular reflected light is high. Meanwhile, the reflectance is low due to the presence of the toners in pattern formation regions having the pattern images of yellow (Y), magenta (M), cyan (C), and black (K) formed thereon. Thus, the read level of the first detection signal P1 output from the first PD 71 that receives the specular reflected light is low. Thus, as shown in FIG. 5, the color misregistration amount can be detected by detecting positions of the toner patterns of yellow (Y), magenta (M), cyan (C), and black (K) with use of a threshold signal. The CPU 109 corrects color misregistration by controlling write timing of the light scanning devices 15 through the light scanning device controller 112 based on the detected color misregistration amount.

(Density Detection Pattern Image)

Figure 6A:
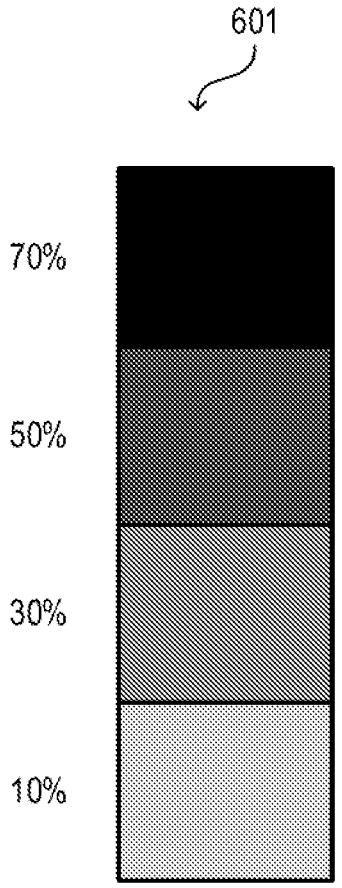
FIG. 6A and FIG. 6B are views for illustrating density detection pattern images.
Figure 6B:
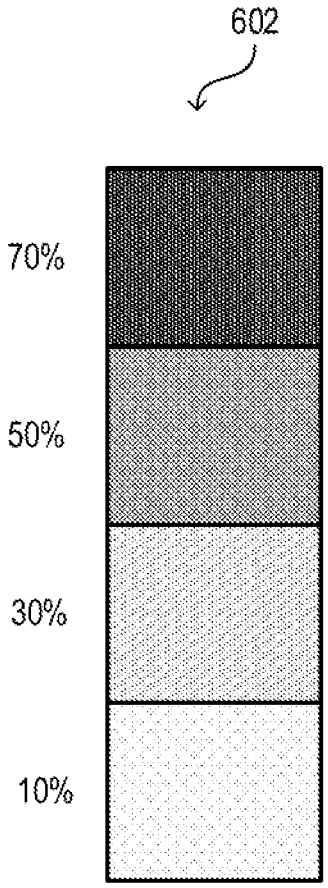

Next, the density detection pattern image to be formed on the intermediate transfer belt 5 when the CPU 109 executes density detection is described. FIG. 6A and FIG. 6B are views for illustrating density detection pattern images. FIG. 6A is a view for illustrating a first density detection pattern image 601 to be formed on the intermediate transfer belt 5 for toner density detection. The first density detection pattern image 601 is used to cause the first PD 71 to receive the specular reflected light of the light emitted from the first LED 73. The first density detection pattern image 601 is formed with a black (K) toner, and is used when black (K) toner density detection is executed. Black (K) has a light absorbing property, and thus cannot be detected based on scattered reflected light. Thus, the toner density of black is detected by using the result of detection performed by the first PD 71 that receives the specular reflected light.

The first density detection pattern image 601 illustrated in FIG. 6A includes four grayscale patterns of 70%, 50%, 30%, and 10% in order of decreasing density. The CPU 109 reads the first density detection pattern image 601 formed on the intermediate transfer belt 5 with use of the pattern sensor 7 to obtain the first detection signal P1 from the first PD 71. The CPU 109 converts the first detection signal P1 into the digital signal through the A/D converter 110, computes a difference between a value of the digital signal and an image density grayscale characteristic to be actually output, and controls the image forming controller 120 based on a result of computation to thereby perform density correction.

Figure 7:
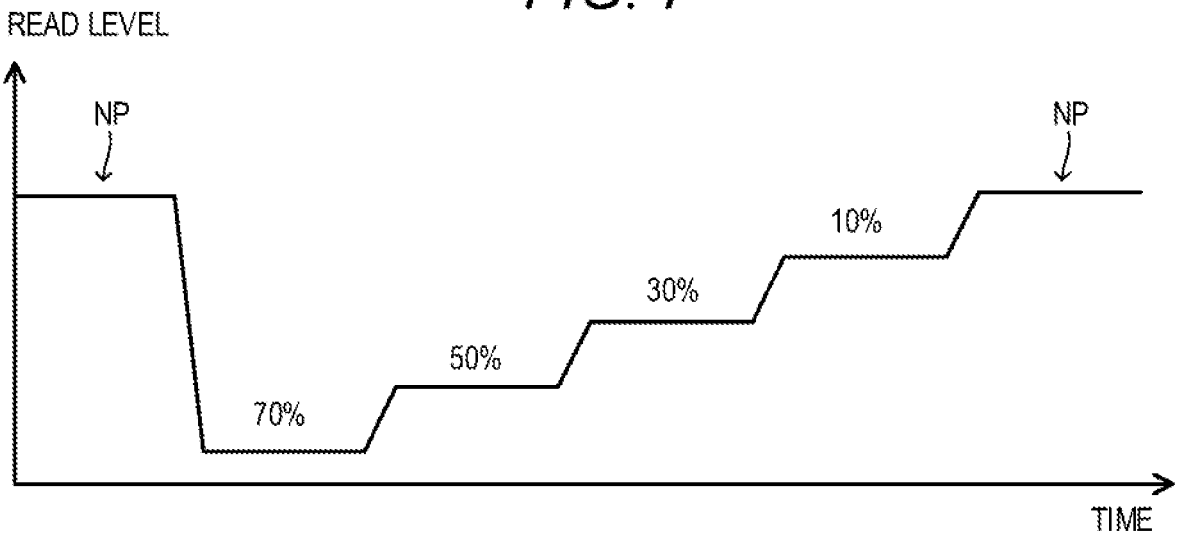
FIG. 7 is a graph for showing an output waveform from the pattern sensor that has detected a first density detection pattern image.

FIG. 7 is a graph for showing an output waveform from the pattern sensor 7 that has detected the first density detection pattern image 601. The light emitted from the first LED 73 is absorbed by the black (K) toner in a 70%-portion having a high density. Further, the 70%-portion has a large toner application amount of the black (K) toner, and hence the specular reflected light from the intermediate transfer belt 5 also decreases. Thus, the read level at the 70%-portion having a high density is low. Meanwhile, a light absorption amount by the black (K) toner in a 10%-portion having a low density is smaller than a light absorption amount in the 70%-portion. Further, the 10%-portion has a small toner application amount of the black (K) toner, and hence the specular reflected light from the intermediate transfer belt 5 increases. Thus, the read level at the 10%-portion having a low density is high. The first density detection pattern image 601 is not formed on non-patterned portions NP, and the specular reflected light from the intermediate transfer belt 5 is large in the non-patterned portions NP. Thus, the read level is high.

FIG. 6B is a view for illustrating a second density detection pattern image 602 to be formed on the intermediate transfer belt 5 for toner density detection. The second density detection pattern image 602 is used to cause the second PD 72 to receive scattered reflected light of the light emitted from the second LED 74. The second density detection pattern image 602 is formed with a yellow (Y) toner, a magenta (M) toner, and a cyan (C) toner, and is used at a time of execution of yellow (Y) toner density detection, magenta (M) toner density detection, and cyan (C) toner density detection. FIG. 6B shows the second density detection pattern image 602 formed with the toner of one color of yellow (Y), magenta (M), and cyan (C). Yellow (Y), magenta (M), and cyan (C) have higher scattering coefficients than that of the intermediate transfer belt 5. Thus, toner densities of yellow (Y), magenta (M), and cyan (C) are detected by using a result of detection performed by the second PD 72 that receives the scattered reflected light.

The second density detection pattern image 602 illustrated in FIG. 6B includes four grayscale patterns of 70%, 50%, 30%, and 10% in order of decreasing density. The CPU 109 reads the second density detection pattern image 602 formed on the intermediate transfer belt 5 with use of the pattern sensor 7 to obtain the second detection signal P2 from the second PD 72. The CPU 109 converts the second detection signal P2 into the digital signal through the A/D converter 110, computes a difference between a value of the digital signal and an image density grayscale characteristic to be actually output, and controls the image forming controller 120 based on a result of computation to thereby perform density correction.

Figure 8:
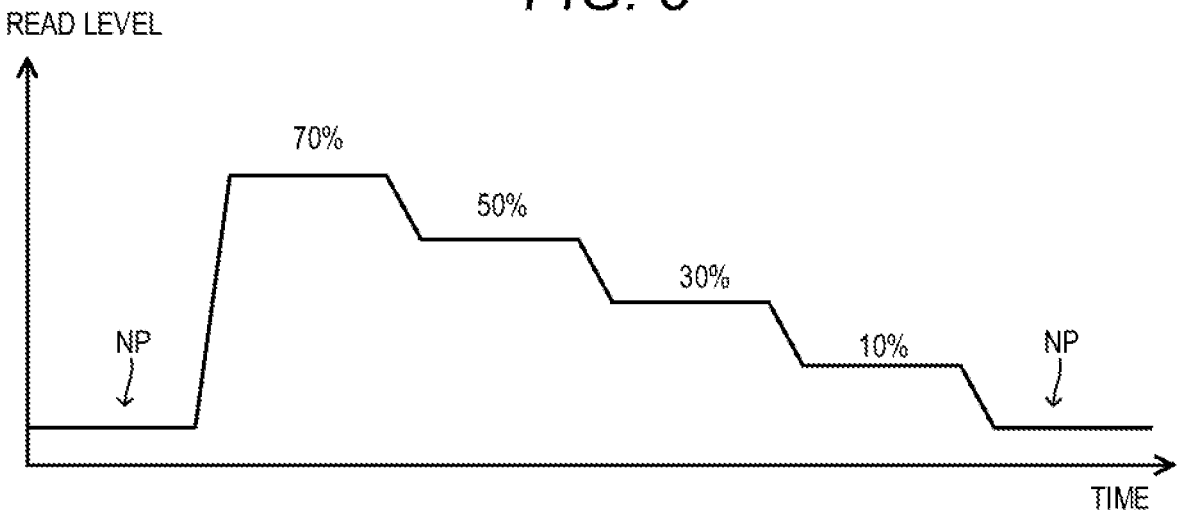
FIG. 8 is a graph for showing an output waveform from the pattern sensor that has detected a second density detection pattern image.

FIG. 8 is a graph for showing an output waveform from the pattern sensor 7 that has detected the second density detection pattern image 602. A case in which the second density detection pattern image 602 is formed with the yellow (Y) toner is described. The light emitted from the second LED 74 is absorbed by the yellow (Y) toner in the 70%-portion having a high density. Further, the 70%-portion has a large toner application amount of the yellow (Y) toner, and hence the scattered reflected light from the yellow (Y) toner also increases. Thus, the read level at the 70%-portion having a high density is high. Meanwhile, a reflectance of the yellow (Y) toner at the 10%-portion having a low density is smaller than that at the 70%-portion, and thus the scattered reflected light decreases. Hence, the read level at the 10%-portion having a low density is low. The second density detection pattern image 602 is not formed on the non-patterned portions NP, and the amount of scattered reflected light from the intermediate transfer belt 5 is small. Thus, the read level is low at the 10%-portion. The toner density detection for the magenta (M) toner and the cyan (C) toner are executed in the same manner as that of the toner density detection for the yellow (Y) toner.

(Attachment Member)

Next, the attachment member 17 to which three pattern sensors 7 are attached is described with reference to FIG. 9A, FIG. 9B, FIG. 9C, and FIG. 9D. FIG. 9A, FIG. 9B, FIG. 9C, and FIG. 9D are views for illustrating the attachment member 17 to which the pattern sensors 7 are attached. FIG. 9A is a side view of the attachment member 17 when viewed in a direction indicated by an arrow IXA in FIG. 1. The direction indicated by the arrow IXA is opposite to the moving direction R1 of the intermediate transfer belt 5. The attachment member 17 has an elongated shape extending in a main scanning direction MS orthogonal to the moving direction R1 (specifically, a sub-scanning direction SS) of the intermediate transfer belt 5. The intermediate transfer belt 5 is arranged in a direction (negative direction) opposite to a direction indicated by an arrow Z, specifically, on a lower side in FIG. 9A. Three pattern sensors 7 are arranged side by side in the main scanning direction MS and fixed to the attachment member 17 with screws 21 serving as fixing members. The three pattern sensors 7 are configured to detect the color misregistration detection pattern image 401, the first density detection pattern image 601, and the second density detection pattern image 602, which are formed on the intermediate transfer belt 5.

The three pattern sensors 7 are arranged side by side in the main scanning direction MS for the following reasons. First, different color misregistration amounts are to be detected in accordance with a main scanning position by detecting three color misregistration detection pattern images 401 formed side by side in the main scanning direction MS. Second, control time for density detection is to be shortened by detecting the second density detection pattern images 602 of three colors, which are formed side by side in the main scanning direction MS, with the three pattern sensors 7.

The pattern sensors 7 are fixed to the attachment member 17 to improve ease of assembly. The pattern sensors 7 are arranged at positions on a back side in the image forming apparatus 100 so as to detect the pattern images formed on the intermediate transfer belt 5. The ease of assembly is more improved in a case in which the attachment member 17 to which the three pattern sensors 7, each being a relatively small component, have been fixed in advance is attached at a position on the back side in the image forming apparatus 100 than in a case in which three pattern sensors 7 are separately fixed at positions on the back side in the image forming apparatus 100.

Three opening portions 17*a* are formed in a side surface 17*s* of the attachment member 17 in such a manner as to correspond to the three pattern sensors 7 fixed to the attachment member 17. When the attachment member 17 is viewed in the direction indicated by the arrow IXA in FIG. 1, the connectors 205 are partially visible through the opening portions 17*a*.

Figure 9B:
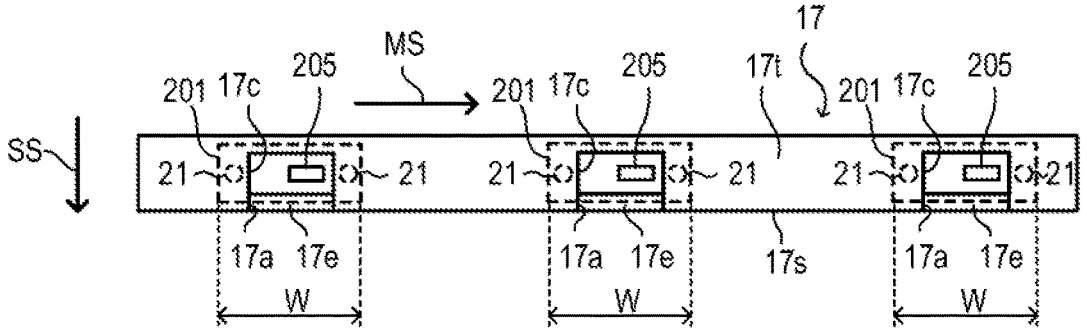

FIG. 9B is a plan view of the attachment member 17 when viewed in a direction indicated by an arrow IXB in FIG. 1. The sub-scanning direction SS is parallel to the moving direction R1. Three opening portions 17*c* are formed in a top surface 17*t* of the attachment member 17 in such a manner as to correspond to the three pattern sensors 7 fixed to the attachment member 17. The opening portions 17*c* are through-holes passing from the top surface 17*t* to a bottom surface 17*b* of the attachment member 17. The connectors 205 are inserted into the opening portions 17*c*. When the attachment member 17 is viewed in the direction indicated by the arrow IXB in FIG. 1, the connectors 205 are visible through the opening portions 17*c*. As illustrated in FIG. 9B, the opening portions 17*c* communicate with the opening portions 17*a*, respectively.

Figure 9C:
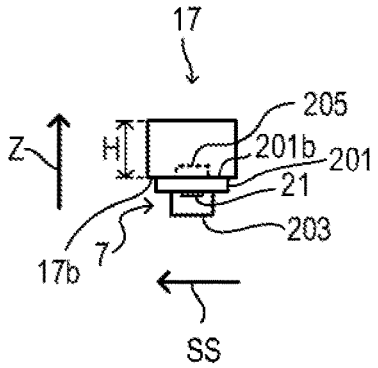
Figure 9D:
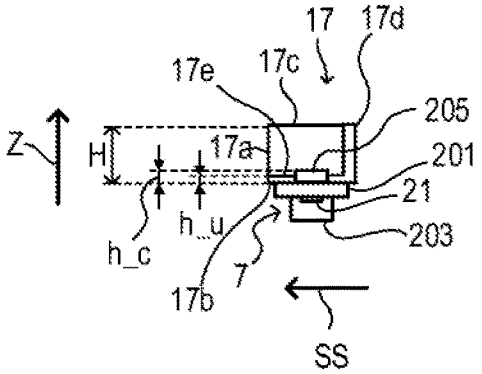

FIG. 9C is an end view of the attachment member 17 when viewed in a direction indicated by an arrow IXC in FIG. 9A. The back surface (second side) 201*b* of the board 201 of the pattern sensor 7 is in contact with the bottom surface 17*b* of the attachment member 17. FIG. 9D is a sectional view of the attachment member 17, which is taken along the line IXD-IXD in FIG. 9A. To increase stiffness of the attachment member 17, a portion of the attachment member 17, which is in non-contact with the pattern sensors 7, has a thickness (second thickness) H in the Z direction (insertion/removal direction of the cable 300) from the bottom surface 17*b* of the attachment member 17 as a reference. As illustrated in FIG. 9A and FIG. 9D, however, the attachment member 17 has a reduced thickness in the vicinity of the pattern sensors 7 on a downstream side in the sub-scanning direction SS. With the reduced thickness, visibility of the connectors 205 when viewed in the direction indicated by the arrow IXA in FIG. 1 and ease of insertion and removal of the cables 300 to and from the connectors 205 are improved.

As illustrated in FIG. 9D, a part (a bottom portion corresponding to the opening portion 17*a*) 17*e* of a portion corresponding to the bottom surface 17*b* of the attachment member 17 contacting the board 201 of the pattern sensor 7, has a thickness (first thickness) h_u in the insertion/removal direction (direction indicated by the arrow Z) of the cable 300. The thickness (first thickness) h_u of the part 17*e* of the portion of the attachment member 17, which is in contact with the back surface 201*b* of the board 201, is smaller than a thickness (second thickness) H of a portion of the attachment member 17, which is in non-contact with the back surface 201*b* of the board 201 in the insertion/removal direction of the cable 300. As illustrated in FIG. 9B, the part 17*e* of the attachment member 17, which has the thickness (first thickness) h_u, falls within a range of a width W of the board 201 in the longitudinal direction.

The thickness h_u of the part 17*e* of the attachment member 17 in the insertion/removal direction (direction indicated by the arrow Z) of the cables 300 from the bottom surface 17*b* as a reference is smaller than a height h_c of the connector 205 of the pattern sensor 7. With the thickness h_u, when the attachment member 17 is viewed from the downstream side in the sub-scanning direction SS, the connectors 205 are visible without being hidden by the attachment member 17. Further, when the cable 300 is to be connected to the connector 205, interference of a hand that holds the cable 300 with the top surface 17*t* of the attachment member 17 can be reduced owing to the opening portion 17*a* communicating with the opening portion 17*c* that allows passage of the cable 300 therethrough. Thus, workability is improved. In this embodiment, the thickness h_u of the bottom portion corresponding to the opening portion 17*a* of the attachment member 17 is equal to or smaller than two-thirds of the height h_c of the connector 205.

In this embodiment, the attachment member 17 is mounted into the image forming apparatus 100 from the downstream side in the sub-scanning direction SS. Thus, the thickness h_u of the part of the bottom portion of the attachment member 17 on the downstream side is reduced. However, when the attachment member 17 is mounted into the image forming apparatus 100 from an upstream side in the sub-scanning direction SS, a thickness of a part of the bottom portion of the attachment member 17 on the upstream side may be reduced to improve the visibility of the connectors 205 and the ease of insertion and removal of the cables 300.

In this embodiment, the attachment member 17 has wall portions 17*d* as illustrated in FIG. 9D so as to increase the stiffness of portions of the attachment member 17, which are located in the vicinity of the connectors 205. The wall portions 17*d* are configured to reinforce the strength of the parts 17*e* of the attachment member 17, which each have the thickness (first thickness) h_u. According to this embodiment, the visibility of the connectors 205 of the pattern sensors 7 and the ease of insertion and removal of the cables 300 are improved while the strength of the attachment member 17 is maintained. In this manner, assembly quality of the attachment member 17 into the image forming apparatus 100 can be improved.

According to the first embodiment, the visibility of the connectors 205 of the pattern sensors 7 is improved while the stiffness of the attachment member 17 is maintained. In this manner, the connector 205 and the cable 300 can easily be connected to each other.

Second Embodiment

Now, a second embodiment is described. In the second embodiment, the same structures as those in the first embodiment are denoted by the same reference symbols, and a description thereof is omitted. The image forming apparatus 100 and the pattern sensors 7 in the second embodiment are the same as those in the first embodiment, and thus a description thereof is omitted. An attachment member 170 of the second embodiment is different from the attachment member 17 of the first embodiment in that the wall portions 17*d* are not provided. Differences are mainly described below.

Figure 10A:
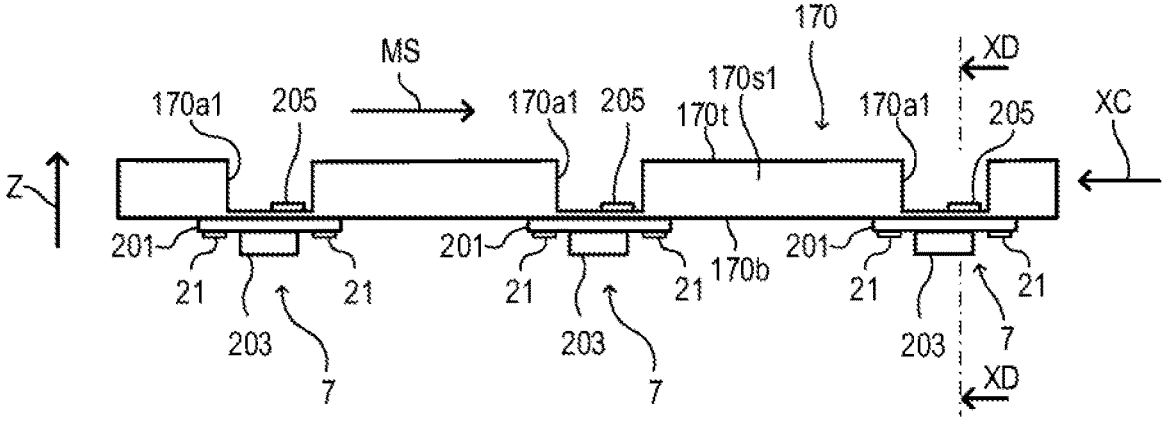
FIG. 10A, FIG. 10B, FIG. 10C, and FIG. 10D are views for illustrating an attachment member of a second embodiment.
Figure 10B:
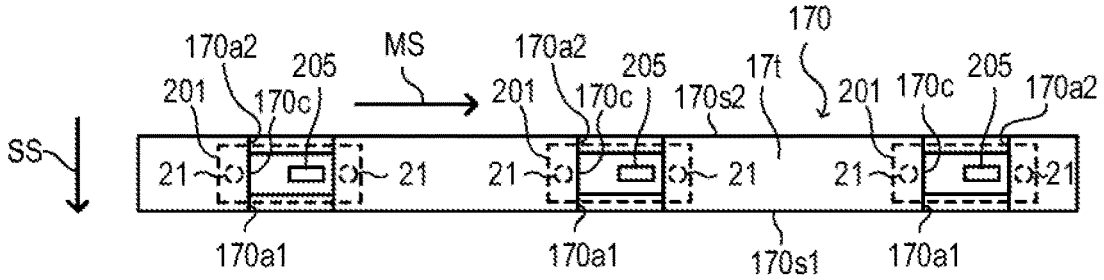

FIG. 10A, FIG. 10B, FIG. 10C, and FIG. 10D are views for illustrating the attachment member 170 of the second embodiment. FIG. 10A is a side view of the attachment member 170. FIG. 10B is a plan view of the attachment member 170. Three opening portions 170*a*1 are formed in one side surface 170*s*1 of the attachment member 170 in such a manner as to correspond to three pattern sensors 7 fixed to the attachment member 170. Three opening portions 170*a*2 are also formed in another side surface 170*s*2 of the attachment member 170 in such a manner as to correspond to the three pattern sensors 7 fixed to the attachment member 170. Three opening portions 170*c* are formed in a bottom surface 170*b* of the attachment member 170 in such a manner as to correspond to the three pattern sensors 7 fixed to the attachment member 170. When the attachment member 170 is viewed along the sub-scanning direction SS, the connectors 205 are partially visible through the opening portions 170*a*2. Further, when the attachment member 170 is viewed along a direction opposite to the sub-scanning direction SS, the connectors 205 are partially visible through the opening portions 170*a*1.

Figure 10C:
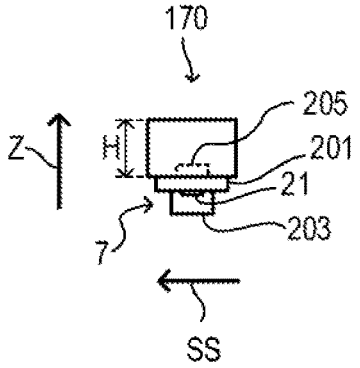
Figure 10D:
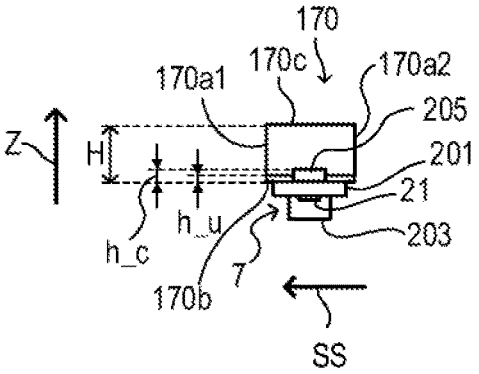

FIG. 10C is an end view of the attachment member 170 when viewed in a direction indicated by an arrow XC in FIG. 10A. FIG. 10D is a sectional view of the attachment member 170, which is taken along the line XD-XD in FIG. 10A. To increase stiffness of the attachment member 170, the attachment member 170, as illustrated in FIG. 10C and FIG. 10D, has a thickness H in the Z direction. As illustrated in FIG. 10A and FIG. 9D, however, the attachment member 170 has a reduced thickness in the vicinity of the pattern sensors 7 on an upstream side and a downstream side in the sub-scanning direction SS. With the reduced thickness, visibility of the connectors 205 when viewed in the sub-scanning direction SS and the direction opposite to the sub-scanning direction SS and ease of insertion and removal of the cables 300 to and from the connectors 205 are improved.

As illustrated in FIG. 10D, the thickness h_u of a part of a portion of the attachment member 170, which corresponds to the bottom surface 170*b* and is in contact with the board 201 of the pattern sensor 7, is smaller than the height h_c of the connector 205 of the pattern sensor 7. With the thickness h_u, when the attachment member 170 is viewed from the upstream side or the downstream side in the sub-scanning direction SS, the connectors 205 are visible without being hidden by the attachment member 170. Further, when the cable 300 is to be connected to the connector 205, interference of a hand that holds the cable 300 with a top surface 170*t* of the attachment member 170 can be reduced owing to the opening portions 170*a*1 and 170*a*2 communicating with the opening portion 170*c* that allows passage of the cable 300 therethrough.

According to the second embodiment, the visibility of the connectors 205 of the pattern sensors 7 is improved while the stiffness of the attachment member 170 is maintained. In this manner, the connector 205 and the cable 300 can easily be connected to each other.

The pattern sensors 7 is arranged in the vicinity of the intermediate transfer belt 5 to detect the pattern image formed on the intermediate transfer belt 5 in the first embodiment and the second embodiment. However, the pattern sensors (optical sensors) 7 may be arranged in the vicinity of the photosensitive drums (image bearing members) 1 to detect a pattern image formed on each of the photosensitive drums 1. In the first embodiment and the second embodiment, a plurality of pattern sensors 7 are fixed to each of the attachment members 17 and 170. However, at least one pattern sensor 7 may be fixed to each of the attachment members 17 and 170.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-080389, filed Apr. 30, 2020, which is hereby incorporated by reference herein in its entirety.

What is claimed is:

1. An image forming apparatus, comprising:

an image bearing member;

an image forming unit configured to form an image on the image bearing member;

a transfer unit configured to transfer the image from the image bearing member to a sheet;

an optical sensor configured to detect a pattern image formed on the image bearing member; and an attachment member to which the optical sensor is attached, wherein the optical sensor includes a circuit board, a light emitting element and a light receiving element, which are provided on a first side of the circuit board, and a connector provided on a second side of the circuit board, which is opposite to the first side, wherein the attachment member has a surface contacting the second side of the circuit board, wherein in an insertion/removal direction of a cable to be connected to the connector, a first thickness, from the surface, of a part of a portion, contacting the second side, of the attachment member is smaller than a second thickness, from the surface, of a portion, not contacting the second side, of the attachment member, and wherein the part of the attachment member which has the first thickness falls within a range of a width of the circuit board in a longitudinal direction of the circuit board.

2. The image forming apparatus according to claim 1, wherein the image bearing member is an intermediate transfer belt or a photosensitive drum.

3. The image forming apparatus according to claim 1, wherein the first thickness is smaller than a height of the connector provided on the second side of the circuit board.

4. The image forming apparatus according to claim 1, wherein the attachment member has a wall portion configured to reinforce the part of the attachment member which has the first thickness.

5. The image forming apparatus according to claim 1, wherein the optical sensor is fixed at a predetermined distance from the image bearing member by the attachment member.

6. The image forming apparatus according to claim 1, wherein the attachment member is provided with a through-hole into which the connector is to be inserted.

7. The image forming apparatus according to claim 1, wherein the optical sensor comprises a plurality of optical sensors, and wherein the attachment member is configured to fix the plurality of optical sensors.

8. An image forming apparatus, comprising:

an image bearing member;

an image forming unit configured to form an image on the image bearing member;

a transfer unit configured to transfer the image from the image bearing member to a sheet;

an optical sensor configured to detect a pattern image formed on the image bearing member, the optical sensor including:

a circuit board, a light emitting element and a light receiving element, which are provided on a first surface of the circuit board, and a connector provided on a second surface of the circuit board, which is opposite to the first surface, the connector being connected to a signal line for controlling the optical sensor; and an attachment member to which the optical sensor is attached, the attachment member including a first portion which supports the second surface of the circuit board and in which a screw hole is formed for fixing the circuit board by a screw, and a second portion in which a through-hole is formed, the connector being positioned in the through-hole in a state in which the optical sensor is attached to the attachment member, wherein the circuit board is fixed to the first portion by the screw which is inserted from the first surface to the second surface, and wherein in a state in which the circuit board of the optical sensor is fixed to the attachment member by the screw, a height of the first portion from the second surface of the circuit board in an insertion direction in which the screw is inserted into the screw hole is higher than a height of the second portion from the second surface of the circuit board in the insertion direction.

9. The image forming apparatus according to claim 8, wherein in the state in which the circuit board of the optical sensor is fixed to the attachment member by the screw, the height of the second portion from the second surface of the circuit board in the insertion direction is lower than a height of the connector in the insertion direction.

10. The image forming apparatus according to claim 8, wherein in the state in which the circuit board of the optical sensor is fixed to the attachment member by the screw, the height of the first portion from the second surface of the circuit board in the insertion direction is higher than a height of the connector in the insertion direction.

11. The image forming apparatus according to claim 8, wherein the screw hole does not penetrate the first portion.

12. The image forming apparatus according to claim 8, wherein another screw hole is formed in the attachment member for fixing the circuit board by a screw, wherein a first through-hole as the screw hole is formed in a first end region in a longitudinal direction of the circuit board, and wherein a second through-hole as another screw hole is formed in a second end region opposite to the first end region in the longitudinal direction of the circuit board.

13. The image forming apparatus according to claim 12, wherein the connector is positioned between the screw hole and the another screw hole in the longitudinal direction.

14. The image forming apparatus according to claim 13, wherein a position of the connector in the longitudinal direction is shifted to one surface of a center position between the screw hole and the another screw hole in the longitudinal direction.

15. The image forming apparatus according to claim 8, wherein the attachment member further includes a wall portion configured to reinforce the second portion, and wherein the wall portion is communicated with the first portion.

16. The image forming apparatus according to claim 8, wherein the image bearing member is an intermediate transfer belt.

17. The image forming apparatus according to claim 8, wherein the image bearing member is a photosensitive drum.

* * * * *